United States Patent [19]

Tsuchiya

[11] Patent Number: 4,653,082

[45] Date of Patent: Mar. 24, 1987

[54] HIGH VOLTAGE GENERATING DEVICE FOR X-RAY APPARATUS

[75] Inventor: Akira Tsuchiya, Ootawara, Japan

[73] Assignee: Kabushiki Kaisha Toshiba, Japan

[21] Appl. No.: 687,246

[22] Filed: Dec. 28, 1984

[30] Foreign Application Priority Data

Jan. 18, 1984 [JP] Japan ..... 59-5534
Jan. 18, 1984 [JP] Japan ..... 59-5538

[51] Int. Cl.[4] ..... H05G 1/00
[52] U.S. Cl. ..... 378/101; 378/104; 378/105; 363/98; 363/17; 363/132
[58] Field of Search ..... 378/101, 104, 114; 363/17, 132, 98; 307/252 UA

[56] References Cited

U.S. PATENT DOCUMENTS

| | | | |
|---|---|---|---|
| 2,213,112 | 8/1940 | Timmons | 378/104 |
| 4,184,075 | 1/1980 | Ebersberger | 378/101 |
| 4,221,968 | 9/1980 | Franke | 378/101 |
| 4,225,788 | 9/1980 | Franke | 378/101 |
| 4,504,895 | 3/1985 | Steigerwald | 378/105 |

FOREIGN PATENT DOCUMENTS 0096843 12/1983 European Pat. Off. ..... 378/101

*Primary Examiner*—Craig E. Church
*Assistant Examiner*—Charles Wieland
*Attorney, Agent, or Firm*—Finnegan, Henderson, Farabow, Garrett & Dunner

[57] ABSTRACT

A high voltage generating device for an X-ray apparatus includes a DC output voltage control device for rectifying and smoothing a commercial AC power source voltage and a resonant circuit comprised of a series circuit of a capacitor and a primary winding of a transformer. The output DC voltage of the DC output voltage control device is supplied to the resonant circuit in a first direction or in a direction opposite to the first direction. The direction in which the voltage is applied to the resonant circuit is switched by a current switching means. Consequently, a high AC voltage is obtained through a secondary winding of the transformer. The AC voltage is converted by a rectifying/smoothing means to an X-ray tube voltage which is applied between an anode and a cathode filament of an X-ray tube. The DC output voltage control device permits its output voltage to be switched to an arbitrary level.

7 Claims, 9 Drawing Figures

HIGH VOLTAGE GENERATING DEVICE FOR X-RAY APPARATUS

FIELD OF THE INVENTION

Field of the Invention

This invention relates to a high voltage generating apparatus for X-ray apparatus and, in particular, an improved high voltage generating apparatus which can vary a high voltage (hereinafter referred to as an X-ray tube voltage) applied between an anode and a cathode filament of an X-ray tube, in which a stabilized X-ray tube voltage can be obtained without any ripple components and any of a plurality of commercial power sources of different voltage levels can be used.

A conventional X-ray device of this type is disclosed in U.S. Pat. No. 4,225,788. The X-ray device comprises a rectifying circuit for rectifying an AC voltage from a power source (normally a commercial power source), first and second smoothing capacitors connected in series between the first and second output terminals of the rectifying circuit, first and second thyristors connected in series between the first and second output terminals of the rectifying circuit, first and second diodes connected in parallel with the first and second thyristors, respectively, and a resonant circuit comprised of a primary winding of a transformer and capacitor connected in series between a junction of the first and second smoothing capacitors and a junction of the first and second thyristors.

The X-ray device is of such a type that the first and second thyristors are alternately controlled by a control device in an ON-OFF fashion, causing the resonant circuit to generate a damping oscillation current to permit a voltage to be induced in the secondary winding of the transformer. The induced voltage is rectified and smoothed to obtain a smoothed DC voltage for use as an X-ray tube voltage.

The high voltage generating device for a conventional X-ray apparatus has an advantage of being simple in its arrangement. The value of an X-ray tube voltage can be varied by varying the firing cycle of the first and second thyristors. Where the X-ray tube voltage is varied in a wider range due to a variation in the firing cycle of the first and second thyristors, a problem will arise as set out below.

FIGS. 1 and 2 each show a relation between a gate pulse supplied to first and second thyristors and a current flowing through the primary winding of a transformer when the first and second thyristors are alternately controlled. In these figures, a denotes a current flowing when the first thyristor is turned ON; b, a current flowing when the second thyristor is turned ON; +I and −I, for current levels; t, for time; and GP1 and GP2, for gate pulse trains supplied to the first and second thyristors, respectively.

FIG. 1 shows a current variation when the gate pulses GP1 and GP2, supplied to the gates of the first and second pulses GP1 and GP2, are shorter in their cycles (maximum firing frequency). In this case, the currents a and b become continuous and the X-ray tube voltage level becomes higher. Furthermore, less ripple components are contained in the X-ray tube voltage.

FIG. 2 shows a current variation when the gate pulses GP1 and GP2, supplied to the gates of the first and second thyristors, are longer in their cycle (low firing frequency). In this case, the currents a, b flow in an interrupted state. Thus, the X-ray tube voltage becomes lower and more ripple components are contained in the X-ray tube voltage.

In consequence, when the X-ray tube voltage level is varied in a wider range by varying the turn-ON cycles of the first and second thyristors, it follows that the lower the X-ray tube voltage level, the more the ripple components are contained in the X-ray tube voltage. With an increase in the ripple components of the X-ray tube voltage, a lower quantity of X-ray plural is generated from the X-ray tube, making it impossible to obtain an excellent X-ray photograph. This is disadvantageous for used in mammography which is taken in a lower X-ray tube voltage area.

In the high voltage generating device of the conventional X-ray apparatus, there is a risk that during the alternating ON-OFF switching of the first and second thyristors the other thyristor will be turned ON before the first thyristor is turned OFF. There is sometimes a situation where, if the damping oscillation frequency is lowered due to a variation, for example, in the constancy of the resonant circuit or if an off-normal cycle of the gate pulse to the thyristor is involved, the first and second thyristors are simultaneously on. In this case, a relatively dangerous state is caused due to a short-circuiting of the power source voltage in the X-ray apparatus.

SUMMARY OF THE INVENTION

A primary object of this invention is to provide a high voltage generating device for X-ray apparatus, which can obtain a stabilized X-ray tube voltage with a minimum ripple component even when an X-ray tube voltage applied between an anode and a cathode filament of an X-ray tube varies in a wider than normal range from a higher level to a lower level.

Another object of this invention is to provide a high voltage generating device for X-ray apparatus, which can use any of a plurality of commercial power sources of different voltage levels.

Another object of this invention is to provide a high voltage generating device for an X-ray apparatus, which can prevent the short-circuiting of a power source voltage in the device and can obtain a more stabilized and more reliable X-ray tube voltage.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the high voltage generating device for an X-ray apparatus of this invention comprises:

a rectifier circuit for rectifying an AC voltage from a power source;

a smoothing circuit for smoothing a rectified output from said rectifier circuit, said smoothing circuit having first and second terminals connected to corresponding output terminals of said rectifier circuit, and comprising a series combination of first and second capacitors connected between the first and second terminals;

a high voltage transformer having primary and seconardary windings;

a resonant circuit having a third capacitor and a primary winding of said high voltage transformer which are connected in series configuration;

a current switching circuit for permitting first and second currents which correspond to the voltages of said first and second capacitors, respectively, to pàss through the resonant circuit, said current switching circuit having first and second switching sections, said first switching section being connected at one terminal to said first terminal and at the other terminal to a junction of said first and second capacitors through the resonant circuit, and said second switching section being connected at one terminal to said junction of said first and second capacitors through said resonant circuit and at the other terminal to said second terminal;

resonant circuit driving means for alternately driving said first and second switching sections, said resonant circuit driving means having a plurality of output gating terminals respectively connected to said first and second switching sections;

means for applying an X-ray tube voltage between an anode and a cathode filament of an X-ray tube, said applying means being connected between a secondary winding of said high voltage transformer and said X-ray tube and including means for rectifying and smoothing an AC voltage induced across said secondary winding; and voltage switching means for permitting the DC voltage output of said smoothing circuit to be switched to one of a plurality of levels, said voltage switching means delivering an output voltage at least to the rectifier circuit.

The accompanying drawings, which are incorporated in and constitute a part of this specification, illustrate embodiments of the invention and, together with the description, serve to explain the principles of the invention.

DETAILED DESCRIPTION OF THE PREFERRED EMBODIMENTS

A high voltage generating device according to the embodiments of this invention will be explained below by referring to the accompanying drawings.

Figure 3:
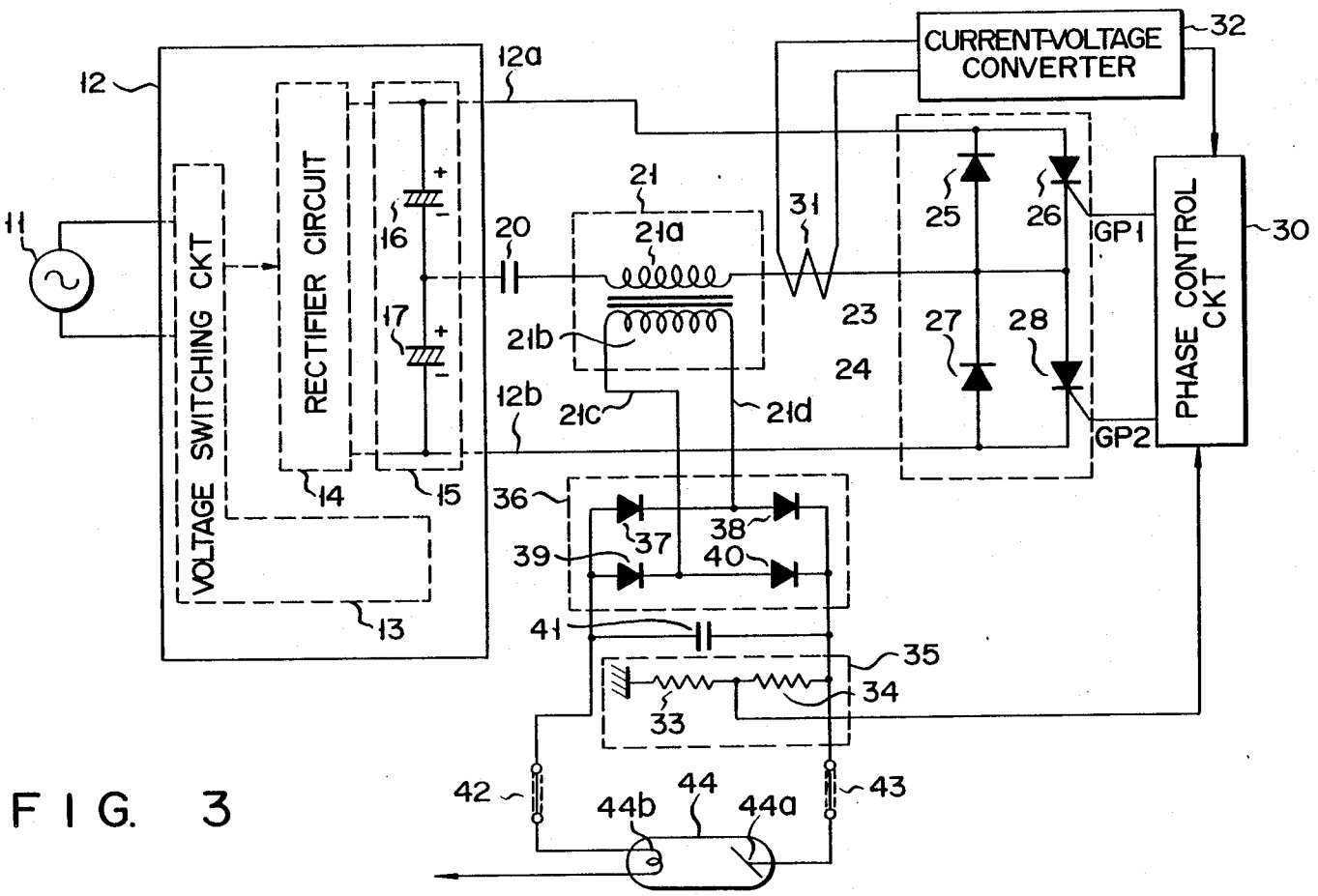
FIG. 3 is a circuit arrangement showing a high voltage generating device constructed according to one embodiment of this invention which is used for X-ray apparatus.

FIG. 3 shows a high voltage generating device constructed according to one embodiment of this invention. In FIG. 3, reference numeral 11 shows, for example, a commercial power source for supplying an AC voltage. The AC voltage of the commercial power source 11 is fed to a DC output voltage control device 12. The DC output voltage control device 12 rectifies the input AC voltage, followed by smoothing it to produce a smoothed DC voltage across output lines 12*a* and 12*b*.

The DC output voltage control device 12 constitutes one of the features section of this invention, and includes a voltage switching circuit 13, rectifier circuit 14 and smoothing circuit 15. As the rectifier circuit 14 use is made of a full-wave rectifier circuit using a diode or a full-wave rectifier circuit using a thyristor. As the voltage switching circuit 13 use is made of, for example, a switch or a gate pulse generating circuit. The rectifier circuit 14 supplies an output to the terminals of the smoothing capacitors 16 and 17 to smooth it to a DC voltage.

A series resonant circuit comprised of a capacitor 20 and a primary winding 21*a* of a transformer 21 is connected at one end to a junction between the smoothing capacitors 16 and 17 and at the other end to a primary current switching circuit 24. A boosted high voltage (AC) is obtained between terminals 21*c* and 21*d* of the transformer 21. A primary current switching circuit 24 permits the direction of a current through the primary winding 21*a* of the transformer 21 to be switched based on a gate pulse from a phase control circuit 30. The primary current switching circuit 24 comprises a parallel circuit (a first switching section) of a diode 25 and thyristor 26 connected in parallel between the lines 12*a* and 23, and a parallel circuit (a second switching section) connected in parallel between the lines 12*b* and 23.

Gate pulses GP1 and GP2 from the phase control circuit 30 are supplied to the gates of the thyristors 26 and 28, respectively. The thyristors 26 and 28 are alternately turned ON by the gate pulses GP1 and GP2. When the thyristor 26 is turned ON by the gate pulse GP1, a current corresponding to the DC voltage of the capacitor 16 flows through the primary winding 21*a* for one half period via the tyristor 26. On account of a damping oscillation phenomenon determined by the resonant capacitor 20 and primary winding 21*a* of the transformer 21 (in a strict sense, it affects the secondary winding 21*b* of the transformer 21), the thyristor 26 which is now on is turned OFF, causing a reverse current to flow for the other half cycle through the diode 25. In consequence, once the thyristor 26 is turned ON, a primary current of one cycle flows through the primary winding 21*a* of the transformer 21.

With the thyristor 28 turned ON by the gate pulse GP2, a current corresponding to the DC voltage of the capacitor 17 flows during one half cycle through the resonant capacitor 20, primary winding 21*a* of the transformer 21 and thyristor 28. Due to the damping oscillation phenomenon determined by the resonant capacitor 20 and primary winding 21*a* of the transformer 21*a*, the thyristor which is on is turned OFF, causing a reverse current to flow through the diode 27 for the other half cycle.

When the primary current flows through the primary winding 21*a* of the transformer 21, a voltage is induced across the secondary winding 21*b* of the transformer 21. The induced voltage is rectified through a rectifier circuit 36 and smoothed through a capacitor 41. The smoothed voltage of the capacitor 41 is applied, as an X-ray tube voltage, across an anode 44*a* and a cathode filament 44*b* of an X-ray tube 44 respectively through high-tension cables 42 and 43. The rectifier circuit 36 is comprised of bridge-connected diodes 37, 38, 39 and 40.

A current through the primary winding 21*a* is detected by a current detector 31. The current detector 31 includes, for example, a current transformer whose output current is supplied to a current/voltage converter 32. The output (a zero-cross detection signal of a current through the resonant circuit) of the current-/voltage converter 32 is used, as thyristor switching data, to control the time at which the gate pulse (GP1, GP2) appears. That is, the phase control circuit 30 automatically adjusts the time of gate output pulse (GP1, GP2) so as to permit the other thyristor to be turned ON after one thyristor has been positively turned OFF.

A voltage detector 35 comprises a series circuit of resistors 33 and 34, and the output of the voltage detector 35 is input as X-ray tube voltage data to the phase control circuit 30. For an X-ray tube voltage lower than a predetermined value, the phase control circuit 30 shortens the cycle of the gate pulse train upon receipt of the corresponding X-ray tube voltage data to raise the X-ray tube voltage, and for the X-ray tube voltage higher than the predetermined value, the phase control circuit 30 elongates the cycle of the gate pulse train upon receipt of the corresponding X-ray tube voltage data to lower the X-ray tube voltage. In this way, the X-ray tube voltage is stably maintained at the predetermined level.

Figure 4:
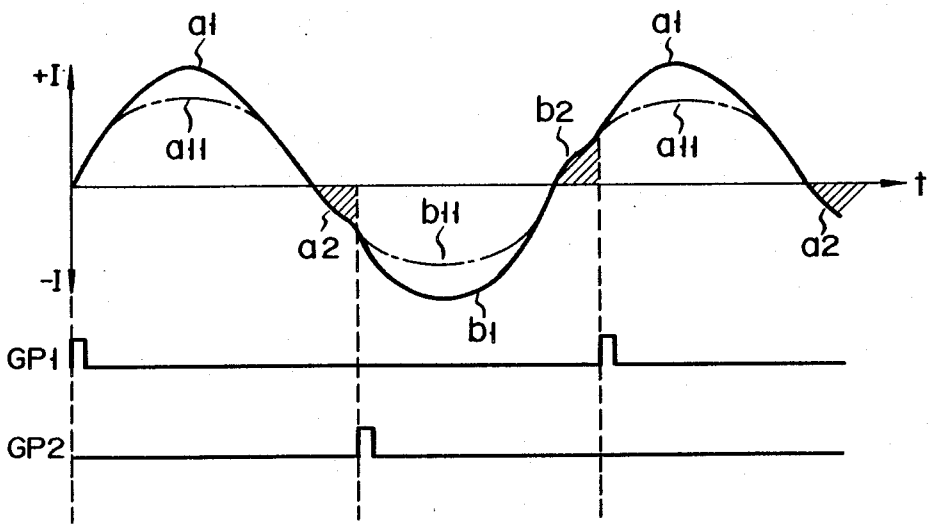
FIG. 4 is a waveform showing a current waveform-to-gate pulse train relationship for explaining the operation of the high voltage generating device of this invention.

FIG. 4 shows a relation of gate pulse trains to the waveform of the current (+I, −I) through the primary winding 21*a* in the transformer 21 of the high voltage generating device for X-ray apparatus.

Figure 1:
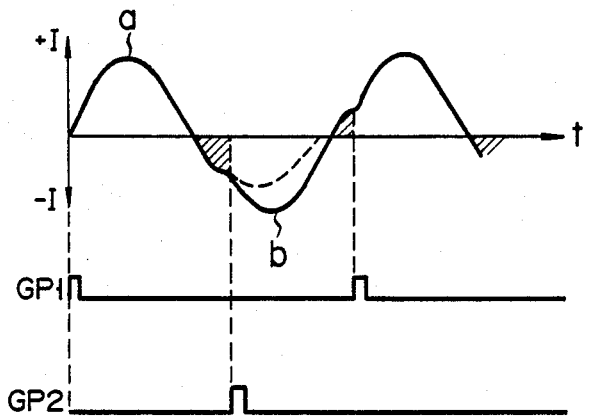
FIGS. 1 and 2 are waveforms showing the relationship of a current waveform to gate pulse trains for explaining the operation of a conventional high voltage generating device for X-ray apparatus.
Figure 2:
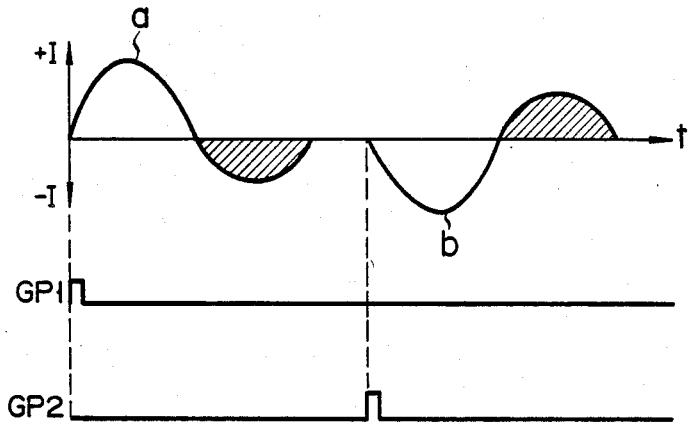

Assume that a DC voltage across the lines (12*a*, 12*b*) is set by the voltage switching circuit 13 to a first level. At this time, the waveform of a current through a thyristor 26 which has been turned ON upon receipt of a gate pulse GP1 is as indicated by a1 in FIG. 1. The waveform of a current flowing through the diode 25 after the turning OFF of the thyristor 26 is as indicated by a2 in FIG. 4. The waveform of a current flowing through the thyristor 28 which has been turned ON upon receipt of the gate pulse GP2 is as indicated by b1 in FIG. 4. The waveform of the current flowing through the diode 27 after the turning OFF of the thyristor 28 is as indicated by b2 in FIG. 4.

Suppose that a DC voltage across the terminals 12*a* and 12*b* is set by the voltage switching circuit 13 to a second level. At this time, the waveform of the current through the thyristor 26 which has been turned ON by the gate pulse GP1 is as indicated by all in FIG. 4 and the waveform of the current flowing through the diode 25 after the turning OFF of the thyristor 26 is substantially equal to a waveform a2 as shown in FIG. 4. The waveform of the current through the thyristor 28 which has been turned ON by the gate pulse CP2 is as indicated by b11 in FIG. 4 and the waveform of the current flowing through the diode 27 after the turning OFF of the thyristor 28 is substantially equal to a waveform b2 as shown in FIG. 4.

According to this invention, therefore, the current voltage which is supplied to the primary winding side of the transformer 21 can be set by the voltage switching circuit 13 to, for example, either one of the two levels. That is, the amplitude of the current through the primary winding 21*a* in the transformer 21 can be set to one of the two levels even if the respective cycles are the same. This means that the X-ray tube voltage level can be varied by the voltage switching circuit 13 even if the respective pulse trains are the same. According to this invention, therefore, since the cycles of the gate pulse trains are equal to each other even if the X-ray tube voltage is switched to another level, there is no risk that the ripple component of the X-ray tube voltage will vary as in the conventional device.

Although the X-ray tube voltage has been explained as being switched to one of two levels, it can be varied in a wider range from a high level to a low level without any variation in ripple components, by switching the output voltage of the DC output voltage control device 12 to one of a number of levels. The device of this invention is effective for a chest X-ray photograph which is to be taken for a lower X-ray tube voltage area.

Although the voltage switching circuit 13 has been explained as a circuit for permitting the DC voltage across the lines 12*a* and 12*b* to be switched to one of a number of levels with the voltage level of the AC power source kept constant, it can also be used as an adaptor when a different voltage level is used for the commercial power source 11. The voltage level of the commercial power source 11 is different from district to district or from country to country. Even in this case, the DC voltage across the terminals 12*a* and 12*b* can be set to a desired level by adjusting the voltage switching circuit 13.

The device includes the phase control circuit 30 supplied with the switching data of the thyristors 26 and 28. The gate pulse (GP1, GP2) is delivered after the other thyristor has been positively turned OFF, preventing a short-circuiting between the thyristors 26 and 28. That is, the gate pulse GR2 is delivered as an output after data representing the turning OFF of the thyristor 26 has been fed as the switching data to the phase control circuit 30. The gate pulse GP1 is delivered as an output after data representing the turn OFF of the thyristor 28 has been fed as the switching data to the phase control circuit 30. In this way, the thyristors 26 and 28 are prevented from being short-circuited, assuring an added safety.

According to this invention, the X-ray voltage data is input to the phase control circuit 30 which includes, for example, a level converter for converting the output voltage level of the voltage detector 35 and a comparator for comparing the output voltage level of the level converter with a reference voltage level. The output voltage of the comparator is fed to a phase control terminal of the oscillator for delivering the gate pulses GP1 and GP2. As a result, the pulses GP1 and GP2 have their frequencies controlled so as to obtain a constant voltage from the comparator (the X-ray tube voltage becomes a desired set value). In consequence, the X-ray tube voltage level is stably maintained to permit an excellent X-ray photograph to be obtained.

Figure 5:
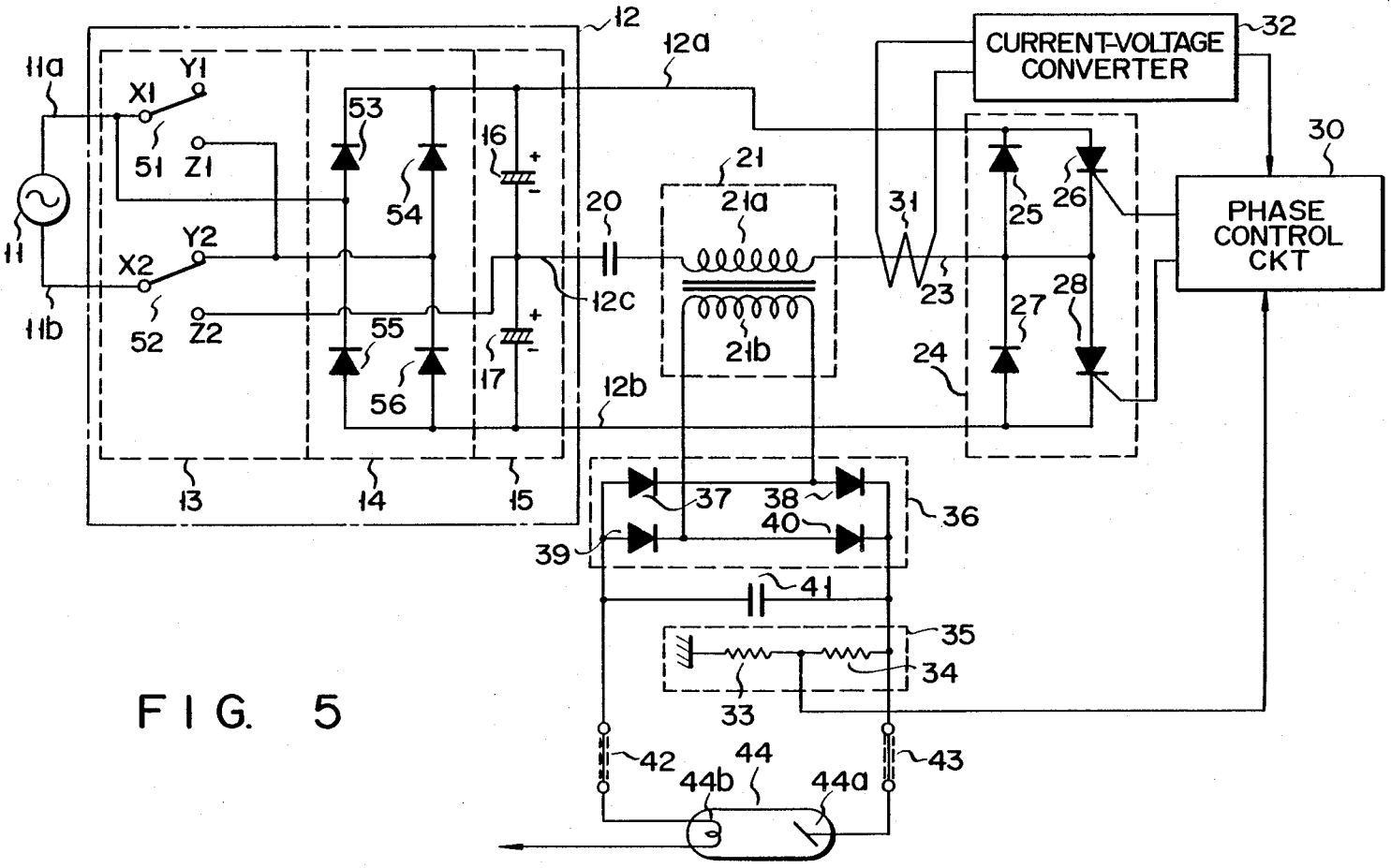
FIGS. 5, 6, 7 and 8, each, show a high voltage generating device constructed according to another embodiment of this invention.

FIG. 5 shows a high voltage generating device according to a second embodiment of this invention. This embodiment is similar to the first embodiment of FIG. 3 except for a voltage switching circuit 13 and rectifier circuit 14. Therefore, identical reference numerals are employed to designate parts or elements corresponding to those in FIG. 3.

The voltage switching circuit 13 includes a switch 51 having its movable contact X1 connected to one terminal 11*a* of a commercial power source 11 and a switch 52 having its movable contact X2 connected to the other terminal 11*b* of the commercial power source 11. The terminal 11*a* of the commercial power source 11 is connected to a junction of diodes 53, 55 of the rectifier circuit 14. The rectifier circuit 14 comprises a full-wave rectifier circuit constituted by a bridge circuit of diodes 53, 54, 55 and 56. A second fixed contact Z1 of the switch 51 and first fixed contact Y2 of the switch 52 are connected to a junction of the diodes 54 and 56. A first fixed contact Y1 of the switch 51 is shown in the open state and a second fixed contact Z2 of the switch 52 is connected to a junction of capacitors 16 and 17 of a smoothing circuit 15.

The operation of the DC output voltage control device 12 will be explained below.

With the movable contacts X1 and X2 of the switches 51 and 52 connected to the fixed contacts Y1 and Y2 (in the state indicated in FIG. 5), respectively, an AC voltage from the commercial power source 11 is full-wave rectified. Thus, a DC voltage corresponding to substantially one-half of the power source voltage, appears across the capacitor 16 and across the capacitor 17. With the movable contacts X1 and X2 of the switches 51 and 52 connected to the fixed contacts Z1 and Z2 thereof, respectively, the AC voltage of the commercial power source 11 is half-wave rectified in a double voltage mode by a series circuit of the diodes 56 and 54 and a series circuit of the capacitors 17 and 16. Consequently, a DC voltage substantially equal to the voltage of the commercial power source 11 emerges across the capacitor 16 and across the capacitor 17.

According to the above-mentioned DC output voltage control device 12, an output DC voltage of the smoothing circuit 15 can be varied in two steps by switching the AC voltage application points in the rectifier circuit 14 and smoothing circuit 15.

Figure 6:
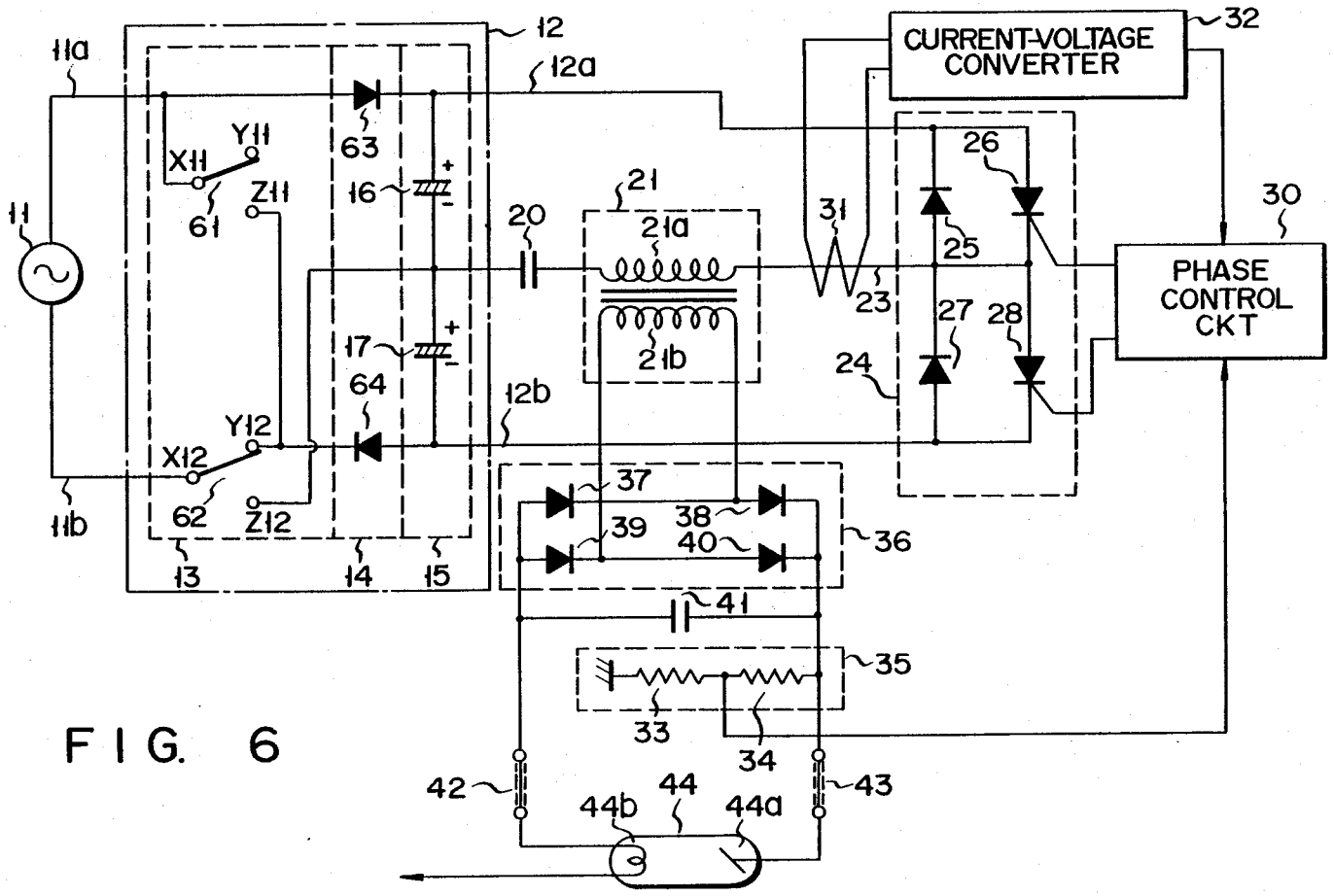

FIG. 6 shows a high voltage generating circuit according to a third embodiment of this invention. This embodiment is substantially similar to the embodiment of FIG. 3 except for another form of a DC output voltage control device 12. Identical reference numerals are employed to designate parts or elements corresponding to those shown in FIG. 3.

The voltage switching circuit 13 includes a switch 61 having its movable contact X11 connected to one terminal 11*a* of a commercial power source 11, and a switch 62 having its movable contact X12 connected to the other terminal 11*b* of the commercial power source 11. The terminal 11*a* of the commercial power source 11 is connected to a lines 12*a* through a diode 63 in a rectifier circuit 14, which diode is connected in a forward direction with its polarities indicated in FIG. 6. A second fixed terminal Z11 of the switch 61 and first fixed terminal Y12 of the switch 62 are connected to a terminal 12*b* through a diode 64 in the rectifier circuit 14, which diode is connected in a reverse direction with its polarities indicated in FIG. 6. In FIG. 6 a first fixed terminal Y11 of the switch 61 is in an open state and a second fixed terminal Z12 of the switch 62 is connected to a junction of capacitors 16 and 17.

In the above-mentioned DC output voltage control device 12, an AC voltage from the commercial power source 11 is half-wave rectified through the diodes 63 and 64 with the movable contacts X11 and X12 of the switches 61 and 62 connected to the fixed contacts Y11 and Y12, respectively. A DC voltage corresponding to substantially one-half of the voltage of the commercial power source 11 appears across the capacitors 16 and 17. With the movable contacts X11 and X12 of the switches 61 and 62 connected to the fixed contacts Z11 and Z12 thereof, respectively, an AC voltage from the commercial power source 11 is half-wave rectified in a double voltage mode by the diodes 63, 64 and capacitors 16, 17. A DC voltage substantially equal to a voltage level of the commercial power source 11 emerges across the capacitor 16 and across the capacitor 17.

In consequence, the DC output voltage control device 12 permits the output DC voltage level to be switched by the voltage switching circuit 13 to one of two output DC voltage levels.

The above-mentioned DC output voltage control device 12 permits the DC voltage level to vary by switching the AC voltage application points in the rectifier circuit 13 and smoothing circuit 14.

This invention is not restricted to the above-mentioned embodiment. A multi-tapped transformer may be connected between the commercial power source 11 and the rectifier circuit 14. A selection of the top position on the transformer permits a variation in the output DC voltage level of the DC output control device 12. The voltage switching circuit 13 may be a slide type transformer. In this case, the output DC voltage level of the DC output voltage control device 12 can be varied by moving the slider along the transformer for adjustment.

Figure 7:
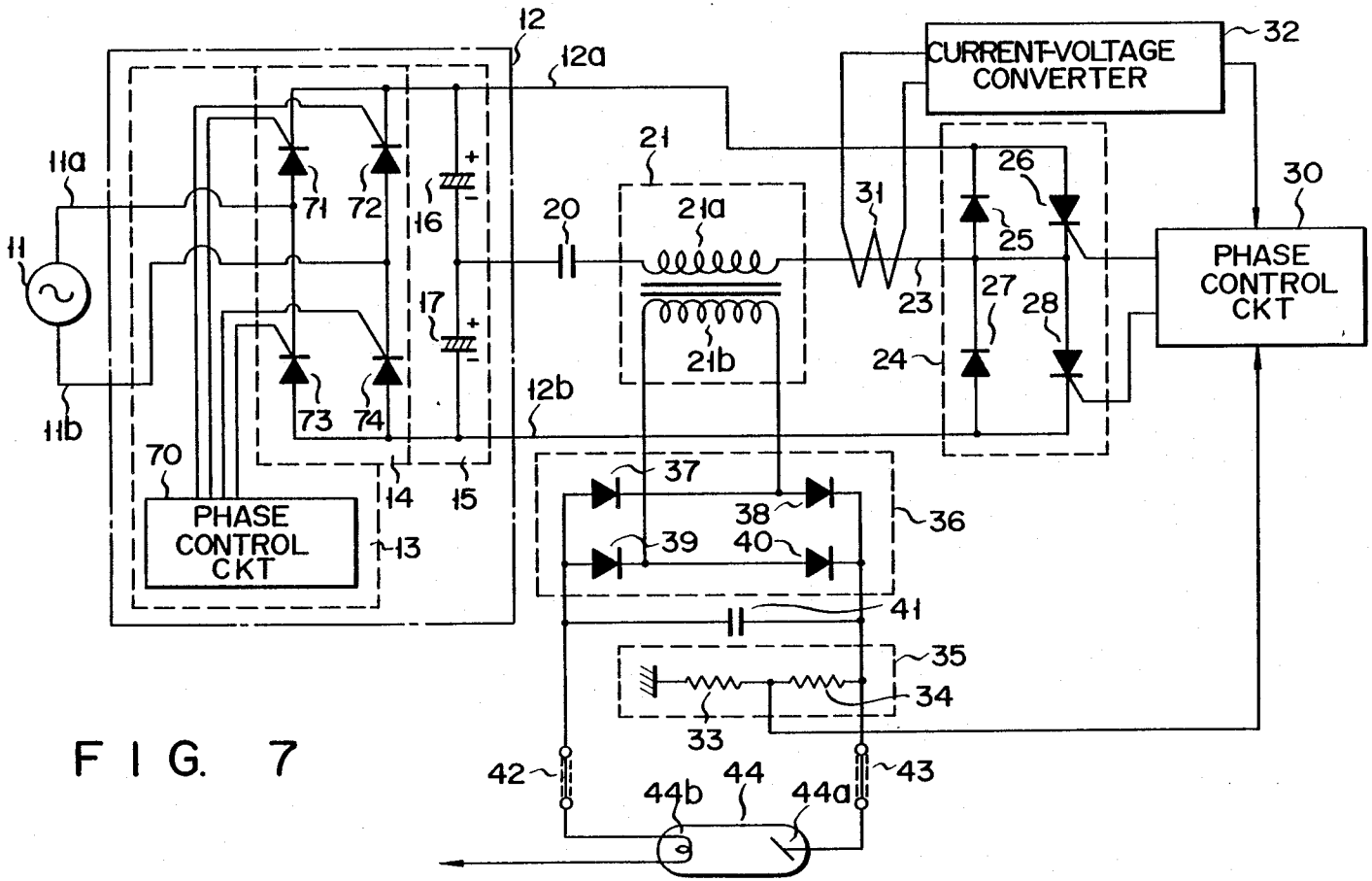

FIG. 7 shows a high voltage generating device according to another embodiment of this invention. This embodiment includes another form of a DC output voltage control circuit 12. This embodiment is similar to the embodiment of FIG. 3 except for a DC output voltage control circuit 12. Identical reference numerals are employed to designate parts or elements corresponding to those shown in FIG. 3.

In the embodiment shown in FIG. 7, thyristors 71, 72, 73 and 74 are connected in a bridge configuration with the cathodes of the thyristors 71 and 72 connected to a terminal 12*a* and the anodes of the thyristors 73 and 74 connected to a terminal 12*b*. Gate pulses of a phase control circuit 70 in the DC output voltage control circuit 12 are supplied to the gates of the corresponding thyristors 71, 72, 73 and 74. A terminal 11*a* of the commercial power source 11 is connected to a junction of the thyristors 71 and 73 and a terminal llb is connected to a junction of the thyristors 72 and 74.

According to this embodiment, when a voltage across the capacitor 16 and the capacitor 17 varies, it is possible to vary the phase of a gate pulse emerging from the phase control circuit 70. It is therefore possible to switch the DC voltage level supplied to a primary winding of a transformer 21. Even in this embodiment, it is possible to obtain a rippleless, stable, X-ray tube voltage level in a range from a high voltage level to a lower voltage level.

Figure 8:
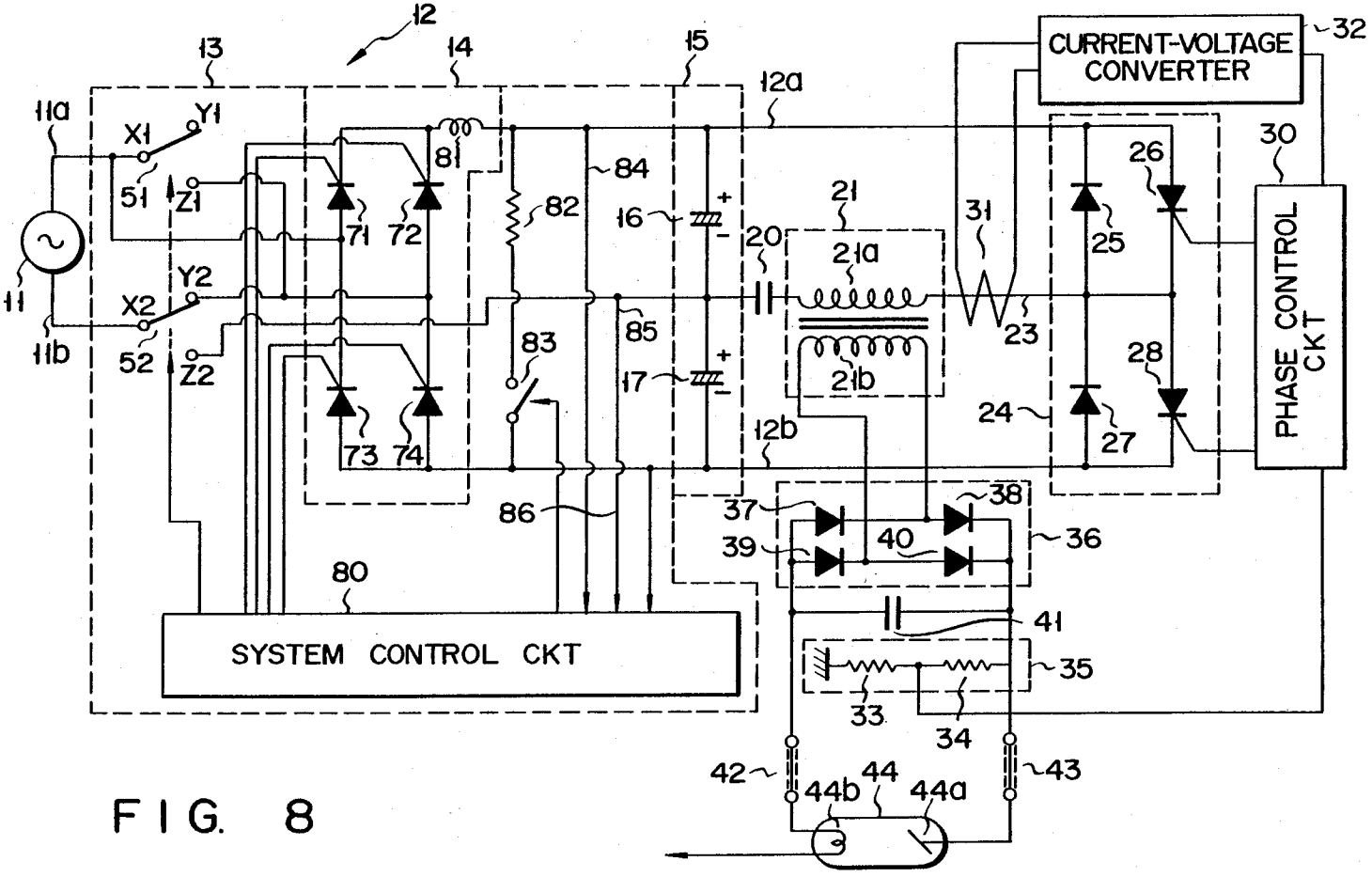

FIG. 8 shows a high voltage generating device according to another embodiment of this invention. This embodiment includes another form of a DC output voltage control device 12 and corresponds to a combination of the embodiments of FIGS. 5 and 7 with a choke coil 81, resistor 82 and switch 83 added thereto. Switches 51, 52 and 83 are controlled by a system control circuit 80. The system control circuit 80 delivers gate pulses to the corresponding gates of thyristors 71, 72, 73 and 74.

A rectifier circuit 14 comprises a bridge circuit of the thyristors 71 to 74. The thyristors 71 and 72 are connected through the choke coil 81 to a line 12*a*. The choke coil 81 prevents a rapid voltage variation resulting from the firing action of the thyristor to obtain a smooth rectified output. The DC output voltage of a smoothing circuit 15 contains no high harmonic components and thus becomes more stable.

A voltage switching circuit 13 comprises, for example, switches 51 and 52, system control circuit 80, resistor 82 and switch 83.

The switches 51, 52 can be used for two purposes: one for switching a DC voltage between the lines 12*a* and 12*b* and the other for permitting the device of this invention to be fitted for the commercial power source when the voltage level of the commercial power source 11 varies. The switches 51 and 52 are switched by a switching signal from the system control circuit 80. The system control circuit 80 includes an operation circuit operated by a user and the states of the switches 51, 52 are controlled by the operation of the operation circuit.

A voltage across a capacitor 16 and a capacitor 17 can be designated by the operation of the operation circuit by the user. Such voltage is supplied through lines 84, 85 and 86 to the system control circuit 80 where it is measured. The measured data is compared in the system control circuit 80 with voltage data designated by the user. When the measured data is greater than the designated data, the system control circuit 80 is switched ON. In consequence, the capacitors 16 and 17 are gradually discharged through a discharge path comprising an adequately greater resistor and switch 82. When the measured data is equal to the designated data during a portion of a discharge period, the system control circuit 80 turns the switch 83 OFF.

It is convenient to use the switches 51 and 52 for the commercial power source 11 to which the device of this invention is applied. Where the level of a DC voltage between the lines 12*a* and 12*b* are to be varied, it is only necessary to vary the cycle of the gate pulses supplied from the system control circuit 80 to the gates of the respective thyristors 71 to 74. The cycle of the gate pulse is determined by the designated data which is delivered in the system control circuit 80 when the user designates the X-ray tube voltage. The designated data can be used also as the control data of an oscillator utilizing, for example, a phase locked loop so as to deliver a gate pulse.

According to this embodiment, a DC voltage between the lines 12*a* and 12*b* is automatically adjusted to a desired level. The device of this invention proves effective in a case where it is used at a low X-ray tube voltage level after having it employed at a high X-ray tube voltage level. Immediately, after the device of this invention has been used at a high X-ray tube voltage level, the capacitors 16 and 17 remains charged at a high voltage level. Now suppose that the device of this invention is started after a high voltage has been switched to a low X-ray tube voltage level with the capacitors 16 and 17 left at the high voltage levels. In this case, an initial X-ray tube voltage becomes an impulse-like voltage. According to this embodiment, however, a DC voltage across the capacitor 16 and the capacitor 17 is set normally to a desired level by the adjusting operation of the system control circuit 80 and discharge path (resistor 82 and switch 83). Thus, the device of this invention is always in a ready state in which it is possible to obtain an excellent X-ray photograph.

Figure 9:
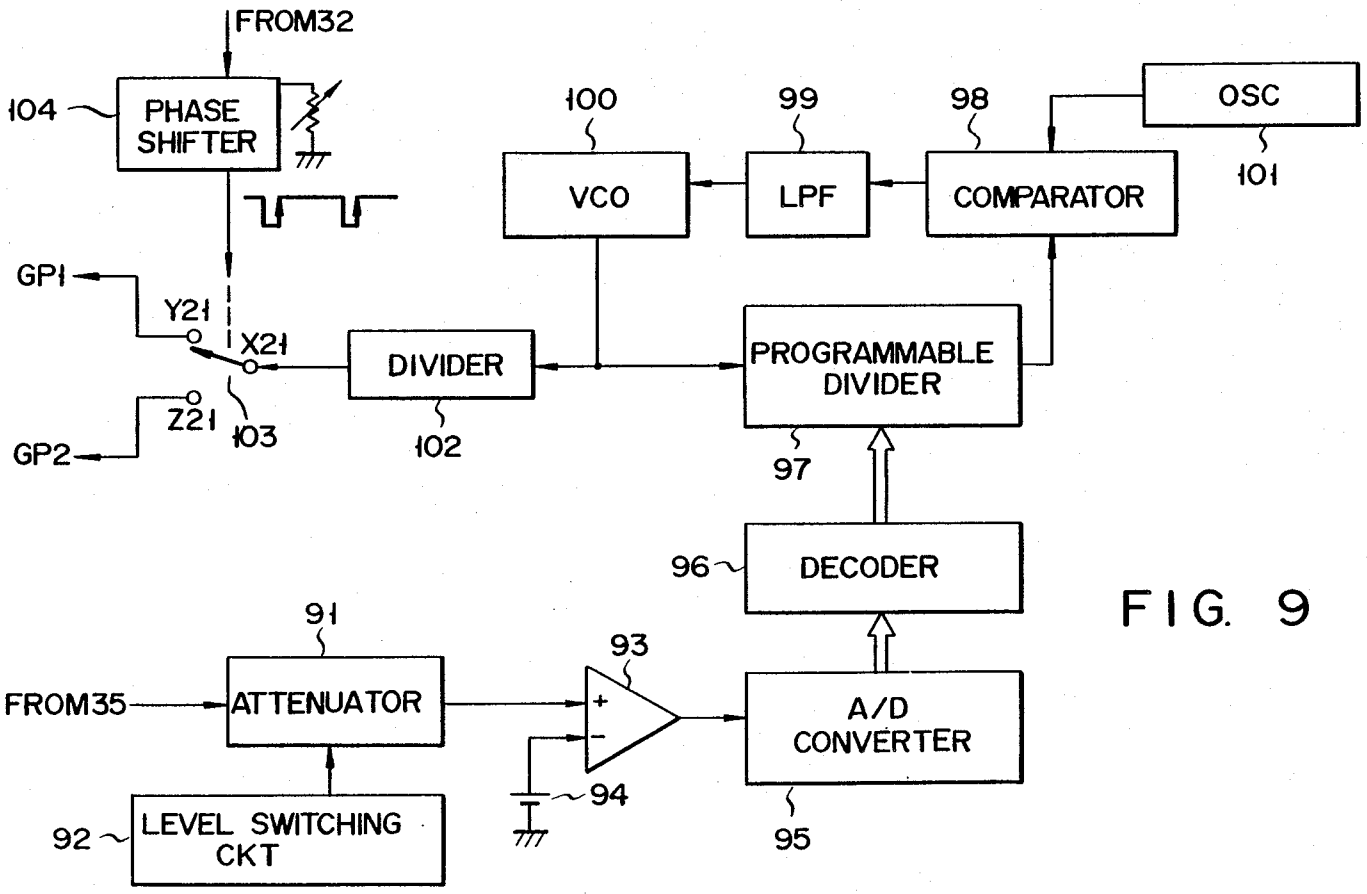
FIG. 9 shows one form of a phase control circuit used in the device of this invention.

FIG. 9 shows a detail of the phase control circuit 30. The output voltage of the voltage detector 35 is supplied to a comparator 93 through an attenuator 91. With the X-ray tube voltage at a higher level, the attenuator 91 is set by a level switching circuit 92 to a greater attenuation level. With the X-ray tube voltage at a lower level, the attenuator 91 is set by the level switching circuit 92 to a smaller attenuation level. The level switching circuit 92 sets the attenuation level corresponding to the X-ray tube voltage select data designated by the user. Even if the X-ray tube voltage is set to either a high level or a low level, a predetermined voltage is supplied to a noninverting input terminal of the comparator 93. A reference voltage is input to an inverting terminal 94 from a reference voltage source 94.

The comparator 93 delivers a difference voltage corresponding to a difference between the voltage of the attenuator 91 and the reference voltage. From this, it will be appreciated that a variation of the difference voltage means that the X-ray tube voltage varies.

The difference voltage of the comparator 93 is supplied to an analog/digital converter 95 where it is converted to digital data. The digital data of the converter 95 is converted by a decoder 96 to phase control data. The phase control data is supplied to a frequency division data input terminal of a programmable divider 97 which constitutes one element of a phase locked loop (PLL). PLL comprises a voltage controlling oscillator (VCO) 100, programmable frequency divider 97, comparator 98 connected to a reference oscillator 101, and low pass filter (LPF) 99. The oscillation frequency of PLL can be varied based on the phase control data. The output of VCO 100 is supplied through a divider 102 to a movable contact X21 of a switch 103. The switch 103 has fixed contacts Y21 and Z21 through which gate pulses GP1 and GP2 are taken out. The conduction states between the contacts X21 and Y21, and between the contacts X21 and Z21, are alternately switched by an output pulse from a phase shifter 104.

The zero-cross detection pulse from the current/voltage converter is supplied to the control terminal of the switch 103 through the phase shifter 104. The output of a phase shifter 104 falls when it receives the zero-cross detection pulse and rises after a lapse of the time t. With a rise in the output of the phase shifter 104, the switch 104 is alternately switched between the conductive state of the contacts X21 and Y21, and the conductive state of the contacts X21 and Z21.

In the phase control circuit 30, the switch 103 is not switched unless the zero-cross detection pulse is obtained. Thus, the thyristors 26 and 28 provide an exact control operation. That is, the thyristor 28 is turned ON only subsequent to the turning OFF of the thyristor 26 and the thyristor 26 is turned ON only after the thyristor 28 is turned OFF. For a varying X-ray tube voltage, the frequency division ratio data of the programmable frequency divider 97 is finely adjusted in an automatic fashion, thereby adjusting the phase of the gate pulse train to permit the X-ray tube voltage to be normally maintained at a desired level in a stable way.

What is claimed is:

1. A high voltage generating device for an X-ray apparatus comprising:

a rectifier circuit for rectifying an AC voltage from a power source;

a smoothing circuit for smoothing a rectified output from said rectifier circuit, said smoothing circuit having first and second terminals connected to corresponding output terminals of said rectifier circuit, and comprising a series circuit of first and second capacitors connected between said first and second terminals;

a high voltage transformer having primary and secondary windings;

a resonant circuit having a third capacitor and said primary winding of said high voltage transformer which are connected in series configuration;

a current switching circuit for permitting first and second currents which correspond to the voltages of said first and second capacitors respectively, to pass through the resonant circuit, said current switching circuit having first and second switching sections, said first switching section being connected at one terminal to said first terminal and at the other terminal to a junction of said first and second capacitors through said resonant circuit, and said second switching section being connected at one terminal to said junction of said first and second capacitors through said resonant circuit and at the other terminal to said second terminal;

resonant circuit driving means for alternately driving said first and second switching sections, said resonant circuit driving means comprising a current detector for detecting a resonant current flowing through said resonant circuit, means for detecting zero-cross points of the resonant current detected by said current detector and providing zero-cross-point detection signals, and phase control means responsive to said zero-cross-point detection signals for alternately supplying first and second gate pulses to said first and second switching sections;

means for applying an X-ray tube voltage between an anode and a cathode filament of an X-ray tube, said applying means being connected between a secondary winding of said high voltage transformer and said X-ray tube and including means for rectifying and smoothing an AC voltage induced across said secondary winding; and voltage switching means for permitting the DC voltage output of said smoothing circuit to be switched to one of a plurality of levels, said voltage switching means delivering an output voltage at least to said rectifier circuit.

2. A high voltage generating device according to claim 1, in which said rectifier circuit comprises a bridge circuit of first, second, third and fourth diodes, said first and second diodes being connected at their cathodes to said first terminal and said third and fourth diodes being connected at their anodes to said second terminal; said voltage switching means having first and second switches, said first switch has its movable terminal connected between one terminal of said power source and a junction of the cathode and anode of said first and third diodes, respectively, with a first fixed contact of said first switch open, said first switch being connected at its second fixed contact to a junction of said anode and cathode of said second and fourth diodes, said second switch having its movable contact connected to the other terminal of said power source and being connected at its first fixed terminal to said junction of said anode and cathode of the second and fourth diodes, respectively, and at its second fixed terminal to the junction of said first and second capacitors.

3. A high voltage generating device according to claim 1, in which said rectifier circuit includes fifth and sixth diodes, said fifth diode being connected at its cathode to said first terminal and at its anode to said one terminal of said power source and said sixth diode being connected at its anode to said second terminal; said voltage switching circuit having third and fourth switches, said third switch having a movable contact connected to one terminal of said power source with a first fixed terminal thereof open and at its second fixed contact to the cathode of said sixth diode, and said fourth switch being connected at its movable contact to the other terminal of said power source, at its first fixed contact to the cathode of said sixth diode and at its second fixed contact to the junction of first and second capacitors.

4. A high voltage generating device according to claim 1, in which said rectifier circuit comprises a bridge circuit of first, second, third and fourth thyristors, said first and second thyristors being connected at their cathodes to said first terminal and said third and fourth thyristors at their anodes to said second terminal; and said voltage switching means is comprised of a first phase control circuit for applying gate pulses to the respective gate terminals of said first, second, third and fourth thyristors.

5. A high voltage generating device according to claim 6 further including a choke coil connected between the cathodes of said first and second thyristors and said first terminal.

6. A high voltage generating device according to claim 1, in which said rectifier circuit includes a bridge circuit of fifth, sixth, seventh and eighth thyristors and a choke coil, said fifth and sixth thyristors being connected at their cathodes to said first terminal through the second choke coil, said seventh and eighth thyristors being connected at their anodes to said second terminal; said voltage switching means having fifth and sixth switches, a system control circuit and a discharge circuit including a switch, said fifth switch being connected at its movable contact to one terminal of said power source and a junction of the anode and cathode of said fifth and seventh thyristors, respectively, with its first fixed contact open, and at its second fixed contact to a junction of the anode and cathode of said sixth and eighth thyristors, respectively, said sixth switch being connected at its movable contact to the other terminal of said power source, at its first fixed contact to a junction of the anode and cathode of said sixth and eighth thyristors and at its second fixed contact to a junction of said first and second capacitors, said discharge circuit is connected in parallel with said smoothing circuit, and said system control circuit permits data which is obtained by measuring a voltage across the first and second capacitors to be compared with designated data, and when said measured data is greater than said designated data, control the switching ON of said discharge circuit to permit the measured data to be made equal to the designated data.

7. A high voltage generating device according to claim 1, which said resonant circuit driving means further comprises a voltage detector for detecting said X-ray tube voltage, said phase control means being connected to said voltage detector for adjusting the cycles of said first and second gate pulses upon receipt of X-ray tube voltage data from said voltage detector.

* * * * *